United States Patent [19]

Tardiff

[11] Patent Number: 5,050,834

[45] Date of Patent: Sep. 24, 1991

[54] MAGNETICALLY SUPPORTED FRAME FOR PHOTOGRAPHIC PICTURE CARDS

[76] Inventor: Calvin L. Tardiff, 778 Northshore Dr., Holland, Mich. 49424

[21] Appl. No.: 505,580

[22] Filed: Apr. 6, 1990

[51] Int. Cl.[5] ..... A47F 1/14

[52] U.S. Cl. ..... 248/467; 248/488; 248/490; 40/156; 40/159

[58] Field of Search ..... 248/467, 488, 490; 40/152, 156, 159

[56] References Cited

U.S. PATENT DOCUMENTS

| | | | |
|---|---|---|---|
| 2,514,047 | 7/1950 | Goforth | 40/152 |
| 2,905,412 | 9/1959 | Kipp | 248/490 |
| 3,541,714 | 11/1970 | Bruck, Jr. | 40/156 |
| 3,553,873 | 1/1971 | Weston | 40/156 |
| 3,817,486 | 6/1974 | Liljequist | 248/467 |
| 3,965,599 | 6/1976 | Ebner | 40/152 |
| 3,981,091 | 9/1976 | Weiner | 40/156 |
| 4,055,319 | 10/1977 | Pendock | 248/488 X |
| 4,176,480 | 12/1979 | Euzarraga | 40/156 X |
| 4,217,710 | 8/1980 | Becker | 40/156 |
| 4,605,292 | 8/1986 | McIntosh | 248/467 X |

*Primary Examiner*—Gary L. Smith
*Assistant Examiner*—Michael J. Milano
*Attorney, Agent, or Firm*—Austin A. Webb

[57] ABSTRACT

A supporting plate of transparent plastic and having parallel side edges has plural holding bars with integrally molded hooks on each end engaged over the opposite side edges of the plate. The bars have flat faces that drawn against the back surface of the plate, and shallow off-sets along the edges of the bars co-act with the back of the plate to form slots that supportingly receive the edges of cards to display the surfaces of the cards through the transparent plate. Permanent magnets adhered to the backs of the cross bars magnetically support the plate, the cross bars and the cards from iron walls of cabinets and appliances.

2 Claims, 1 Drawing Sheet

MAGNETICALLY SUPPORTED FRAME FOR PHOTOGRAPHIC PICTURE CARDS

SUMMARY OF INVENTION

The invention resides in the provision of plural narrow cross bars of transparent plastic with integral hooks on their ends that snap over opposite edges of a transparent plastic plate to overlay the back of the plastic sheet. The strips have magnets adherently secured to their back sides to magnetically support the plastic plate from a metal surface such as a metal door or refrigerator wall. The front surfaces of the cross bars have ribs molded therealong which form slots to receive the edges of the picture cards and hold the cards, face outwardly, in selectively adjustable positions under or behind the plastic plate.

DESCRIPTION OF DRAWINGS

The drawings, of which there is one sheet, show a preferred form of the invention.

DETAILED DESCRIPTION

Figure 1:
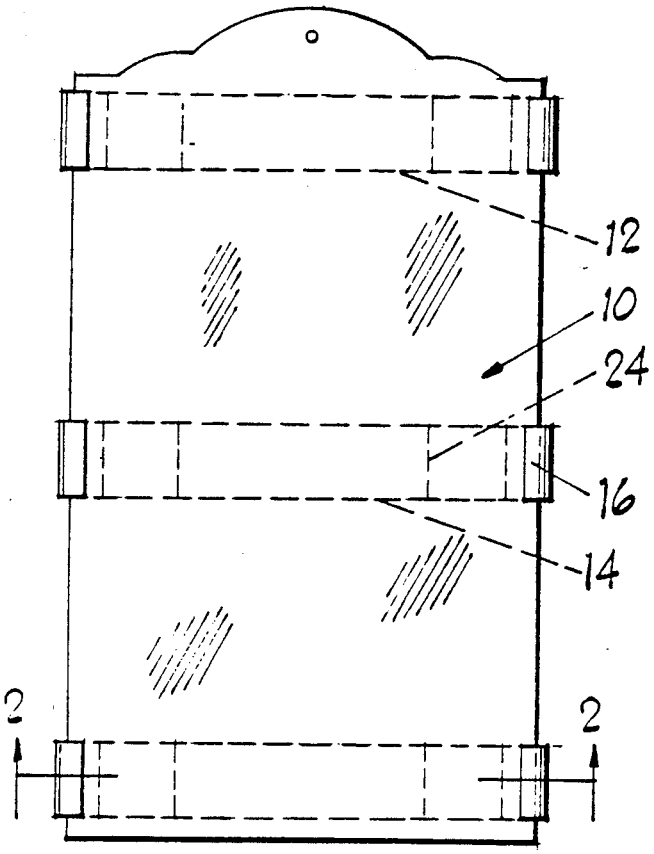
FIG. 1 is a front elevational view of a transparent plastic plate with plural cross bars adjustably engaged across its back side.
Figure 3:
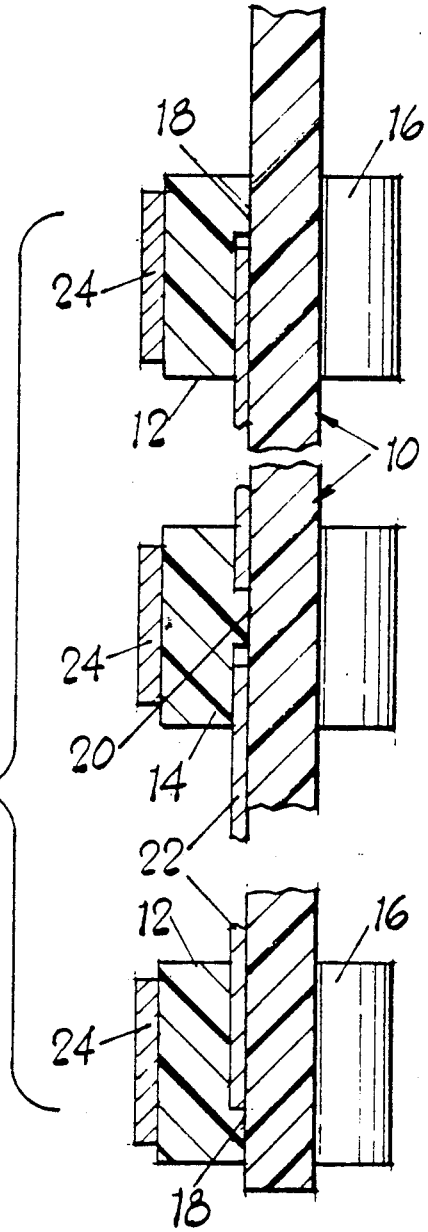
FIG. 3 is a fragmentary vertical cross sectional view taken along the plane of the line 3—3 in FIG. 2 and looking in the direction of the arrows.
Figure 2:
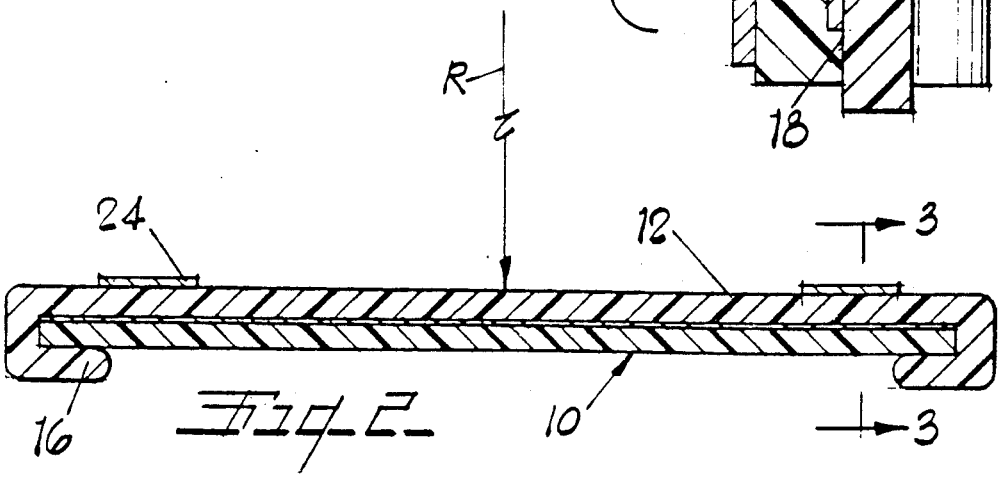
FIG. 2 is an enlarged horizontal cross sectional view taken along the plane of the line 2—2 on FIG. 1 and looking in the direction of the arrows.

The transparent plate 10, which forms the body of the invention, is made of clear acrylic plastic and has parallel side edges which are embraced by upper and lower cross bars 12 and an intermediate cross bar 14. Note that the upper bar 12 is the same as the lower bar 12 but in an inverted position. Each bar 12 and 14 has an integrally formed reverse bend hook 16 on each end which fits adjustably around the opposite side edges of the plate. The bars 12 have thin marginal flanges 18 along one edge, and the interior cross bar 14 has a central rib 20. These co-act with the rear face of the main plate 10 to define slots for retainingly receiving the side edges of photographic or other ornamental cards which are indicated at 22. Plates 24 of permanent magnetic material are secured, as by adhesive, to the back sides of the bars 12 and 14. The bars 12 and 14 are further bowed convexly outwardly toward the back side of the plate 10. The degree of bowing is very slight and is visually unnoticeable, but is definitely molded into the bars. The radius of curvature, as conventionally indicated by the letter R in FIG. 2 is of order of fifteen times the length of the bars 12 and 14, or about 150 inches for bars ten inches long. This slight bowing of the bars assures that the cards 20 will be held under pressure against the rear side of the plate 10 and also assures continuous holding pressure of the hooks 16 on the edges of the plate.

I claim:

1. In combination with a supporting plate having parallel side edges, a pair of elongated holding bars adapted to span said side edges of said plate and each bar having an integrally molded hook flange on each sized to fit the thickness of said plate at its side edges, said flanges extending reversely in overlapping relation to the body of the bar to frictionally grip the side edges of the plate, each of said holding bars having an integrally molded projection along one edge of its side facing said hooks to supportingly and retainingly engage the edges of cards between said plate and said bars, said bars being molded with a slight convex bow toward said hooks whereby the bars are are tensioned against the surface of said plate when applied thereto.

2. The combination as defined in claim 1 in which the bow in said holding bars is of a radius of the order of fifteen times the length of the bars.

* * * * *